US009905166B2

(12) United States Patent
Qing et al.

(10) Patent No.: US 9,905,166 B2
(45) Date of Patent: Feb. 27, 2018

(54) PIXEL DRIVING CIRCUIT, PIXEL DRIVING METHOD AND DISPLAY APPARATUS

(71) Applicants: BOE TECHNOLOGY GROUP CO., LTD., Beijing (CN); Chengdu BOE Optoelectronics Technology Co., Ltd., Chengdu, Sichuan Province (CN)

(72) Inventors: Haigang Qing, Beijing (CN); Xiaojing Qi, Beijing (CN)

(73) Assignees: BOE TECHNOLOGY GROUP CO., LTD., Beijing (CN); Chengdu BOE Optoelectronics Technology Co., Ltd., Chengdu, Sichuan Province (CN)

( * ) Notice: Subject to any disclaimer, the term of this patent is extended or adjusted under 35 U.S.C. 154(b) by 249 days.

(21) Appl. No.: 14/892,553

(22) PCT Filed: May 27, 2015

(86) PCT No.: PCT/CN2015/079904
§ 371 (c)(1),
(2) Date: Nov. 19, 2015

(87) PCT Pub. No.: WO2016/086627
PCT Pub. Date: Jun. 9, 2016

(65) Prior Publication Data

US 2016/0358550 A1 Dec. 8, 2016

(30) Foreign Application Priority Data

Dec. 2, 2014 (CN) ..... 2014 1 0722880

(51) Int. Cl.
*G09G 3/32* (2016.01)
*G09G 3/3258* (2016.01)
(Continued)

(52) U.S. Cl.
CPC ..... *G09G 3/3258* (2013.01); *G09G 3/32* (2013.01); *G09G 3/3266* (2013.01);
(Continued)

(58) Field of Classification Search
None
See application file for complete search history.

(56) References Cited

U.S. PATENT DOCUMENTS 8,248,334 B2 8/2012 Toyomura et al.
2006/0170628 A1* 8/2006 Yamashita ..... G09G 3/3233 345/76
(Continued)

FOREIGN PATENT DOCUMENTS

CN 101079234 A 11/2007
CN 107097689 A 1/2008
(Continued)

OTHER PUBLICATIONS

Chinese Rejection Decision, for Chinese Patent Application No. 2014107228803, dated Sep. 2, 2016, 18 pages.
(Continued)

*Primary Examiner* — Joseph Haley
*Assistant Examiner* — Emily Frank
(74) *Attorney, Agent, or Firm* — Kinney & Lange, P.A.

(57) ABSTRACT

The present disclosure relates to a pixel driving circuit, a display apparatus and a pixel driving method. The pixel driving circuit comprises a reset unit. The reset unit is arranged to enable the storage capacitor to store not only a data voltage but also a threshold voltage of the driving unit in the charging phase, to compensate for the driving unit in the driving phase, so that the operating current of the driving unit is not influenced by the threshold voltage. This eliminates the influence of the threshold voltage of the driving unit to the operating current of the driving unit. Further, the
(Continued)

reset unit is moved outside an active display area, and is shared by a row of pixel driving circuits, which can significantly increase the aperture rate of the pixels.

14 Claims, 5 Drawing Sheets

(51) Int. Cl.
*G09G 3/3266* (2016.01)
*G09G 3/3283* (2016.01)

(52) U.S. Cl.
CPC ..... *G09G 3/3283* (2013.01); *G09G 2300/043* (2013.01); *G09G 2300/0842* (2013.01); *G09G 2310/08* (2013.01); *G09G 2320/0233* (2013.01); *G09G 2320/043* (2013.01)

(56) References Cited

U.S. PATENT DOCUMENTS

| | | | | |
|---|---|---|---|---|
| 2008/0204374 | A1 | 8/2008 | Weitbruch et al. | |
| 2011/0080395 | A1 | 4/2011 | Chung | |
| 2013/0120337 | A1 | 5/2013 | Guo et al. | |
| 2015/0356924 | A1* | 12/2015 | Chen | G09G 3/3233 345/690 |

FOREIGN PATENT DOCUMENTS

| | | | |
|---|---|---|---|
| CN | 101710481 | A | 5/2010 |
| CN | 101800024 | A | 8/2010 |
| CN | 202454223 | U | 9/2012 |
| CN | 103714778 | A | 4/2014 |
| CN | 103971638 | A | 8/2014 |
| CN | 203882587 | U | 10/2014 |
| CN | 203882588 | U | 10/2014 |
| CN | 104157240 | A | 11/2014 |
| CN | 104157241 | A | 11/2014 |
| CN | 104332138 | A | 2/2015 |
| CN | 103280181 | B | 12/2015 |

OTHER PUBLICATIONS

International Search Report and Written Opinion (including English translation of Box V of the Written Opinion), dated Aug. 26, 2015, for corresponding PCT Application No. PCT/CN2015/079904.
Extended European Search Report, for European Patent Application No. 15793667.5, dated Apr. 18, 2017, 13 pages.
First Chinese Office Action (including English translation) dated Mar. 25, 2016, for corresponding Chinese Application No. 201410722880.3.

* cited by examiner

PIXEL DRIVING CIRCUIT, PIXEL DRIVING METHOD AND DISPLAY APPARATUS

CROSS-REFERENCE TO RELATED APPLICATION(S)

This application is a Section 371 National Stage Application of International Application No. PCT/CN2015/079904, filed on 27 May 2015, entitled "PIXEL DRIVING CIRCUIT, PIXEL DRIVING METHOD AND DISPLAY APPARATUS", which has not yet published, which claims priority to Chinese Application No. 201410722880.3, filed on 2 Dec. 2014, incorporated herein by reference in their entirety.

TECHNICAL FIELD

The present disclosure relates to the field of display technology, and more particularly, to a pixel driving circuit, a display apparatus, and a pixel driving method.

BACKGROUND

Active Matrix/Organic Light-Emitting Displays (AMOLEDs) are one of hotspots in the research field of flat panel display today. Compared with Liquid Crystal Displays (LCDs), Organic Light-Emitting Diodes (OLEDs) have advantages such as low energy consumption, a low production cost, self-illumination, a wide angle of view, a fast response speed or the like. Currently, in the display field of mobile phones, PDAs, digital cameras or the like, OLEDs have begun to replace conventional LCD screens.

Compared with Thin Film Field Effect Transistor (TFT)-LCDs using a stable voltage to control brightness, OLEDs belong to current drive, and need stable current to control light emitting. As shown in FIG. 1, a conventional AMOLED pixel driving circuit is implemented using a 2T1C pixel driving circuit. The circuit only comprises one Driving Thin Film Transistor (DTFT), one switch Thin Film Transistor (TFT) (i.e., T1) and one storage capacitor C. When a certain row is gated (i.e., scanned) by scanning lines, a scanning signal Vscan is at a low level, T1 is turned on, and a data signal Vdata is written into the storage capacitor C. After the scanning for this row ends, Vscan is converted into a high level signal, T1 is turned off, and the DTFT is driven by a gate voltage stored in the storage capacitor C, to generate current to drive the OLED, so as to ensure that the OLED continuously emits light in one frame of display. A current equation when the driving thin film transistor DTFT reaches saturation is $I_{oled}=K(Vgs-Vth)^2$, wherein K is a parameter related to a process and a design, Vgs is a gate-source voltage for driving the thin film transistor, and Vth is a threshold voltage for driving the thin film transistor. FIG. 2 illustrates a timing diagram of an operation of the pixel driving circuit illustrated in FIG. 1, i.e., illustrating a timing relationship between a scanning signal provided by the scanning lines and a data signal provided by data line.

The AMOLED can emit light since it is driven by current generated by the driving thin film transistor DTFT in a saturation state. No matter a Low Temperature Poly Silicon (LTPS) process or an Oxide process is used, due to non-uniformity of the processes, threshold voltages of the driving thin film transistor DTFT in different positions may differ. Since when the same driving voltage is input, different threshold voltages may cause generation of different driving currents, inconsistency of current flowing through the OLED may occur, which results in non-uniformity of display brightness, thereby influencing the display effect of the whole image.

The existing proposed solutions are to add a compensation unit in each pixel to eliminate the influence of the threshold voltage Vth by compensating for the driving transistor. However, such solutions may result in a rapid reduction in an aperture ratio due to an increased number of transistors in the compensation unit. In a condition that the driving current is unchanged, although a display panel with a low aperture ratio may not have reduced brightness, a current density of an organic light emitting layer thereof necessarily increases, which may easily result in aging of a material of the organic light emitting layer, thereby reducing the usage life of the whole display panel.

Therefore, there is a need for a method which can enhance the consistency of the driving current for driving the transistors, thereby improving the display quality without increasing the current density.

SUMMARY

The present disclosure proposes a pixel driving circuit, a display apparatus, and a pixel driving method.

According to an aspect of the present disclosure, a pixel driving circuit for driving a light-emitting element is proposed, comprising: a scanning line configured to provide a scanning signal; a power line comprising a first power line and a second power line and configured to provide power to the pixel driving circuit; and a data line configured to provide a data signal; a light-emitting control signal line configured to provide a light-emitting control signal; a driving unit having an input end connected to one end of the light-emitting element, a control end connected to a first intermediate node, and an output end connected to a second intermediate node, wherein the light-emitting element has the other end connected to the first power line; a charging unit having an input end connected to the data line, a control end connected to the scanning line, and an output end connected to the first intermediate node; a storage unit having a first end connected to the second intermediate node and a second end connected to a third intermediate node; a reset unit having an input end connected to a reference signal line, a control end connected to the scanning line, and an output end connected to the third intermediate node; and a light-emitting control unit having a first input end connected to the second power line, a second input end connected to the first intermediate node, a control end connected to the light-emitting control signal line, a first output end connected to the second intermediate node, and a second output end connected to the third intermediate node; wherein in a charging phase of the pixel driving circuit, the data line and the first intermediate node are conducted by the charging unit and the reference signal line and the third intermediate node are conducted by the reset unit under a control of the scanning signal, the driving unit provides a charging voltage related to a data voltage and a threshold voltage thereof at the output end under a control of the data signal, and the storage unit storages the charging voltage; and in a driving phase of the pixel driving circuit, the first intermediate node and the third intermediate node are conducted by the light-emitting control unit under a control of the light-emitting control signal, to conduct the second end of the storage unit and the control end of the driving unit, so that a driving current provided by the driving unit to the light-emitting element is unrelated to the threshold voltage thereof.

Preferably, the driving unit comprises a driving transistor, having a gate connected to the first intermediate node, a first electrode connected to said one end of the light-emitting element, and a second electrode connected to the second intermediate node, wherein the first electrode is one of a source and a drain, and the second electrode is the other of the source and the drain.

Preferably, the reference signal line provides a direct current reference voltage larger than the data voltage, and the reset unit comprises: a switch transistor having a gate connected to the scanning line, a first electrode connected to the reference signal line, and a second electrode connected to the third intermediate node, wherein the first electrode is one of a source and a drain, and the second electrode is the other of the source and the drain.

Preferably, the light-emitting control unit comprises a first transistor and a third transistor, in which each of the first transistor and the third transistor has a gate connected to the light-emitting control signal line, the first transistor has a first electrode connected to the second intermediate node and a second electrode connected to the second power line, and the third transistor has a first electrode connected to the first intermediate node and a second electrode connected to the third intermediate node, wherein the first electrode is one of a source and a drain, and the second electrode is the other of the source and the drain.

Preferably, the charging unit comprises a second transistor having a gate connected to the scanning line, a first electrode connected to the data line, and a second electrode connected to the first intermediate node, wherein the first electrode is one of a source and a drain, and the second electrode is the other of the source and the drain.

Preferably, the storage unit comprises a storage capacitor.

Preferably, the driving transistor, the switch transistor, the first transistor, the second transistor and the third transistor are N-type thin film transistors.

According to a second aspect of the present disclosure, a display apparatus is provided, comprising multiple light-emitting elements and the pixel driving circuits for driving the light-emitting elements described above.

Preferably, a row of pixel driving circuits connected to the same scanning line share a reset unit.

Preferably, the shared reset unit is arranged outside an active display area.

According to a third aspect of the present disclosure, a pixel driving method applied in the pixel driving circuit described above is provided, comprising: providing power to the pixel driving circuit through a power line; providing a scanning signal through the scanning line; and providing a light-emitting control signal through the light-emitting signal line, wherein the light-emitting control signal is at a low level when the scanning signal is at a high level, so that the pixel driving circuit enters a charging phase, and the light-emitting control signal changes to a high level when the scanning signal changes from the high level to a low level, so that the pixel driving circuit enters a driving phase.

Preferably, when the scanning signal is at a high level, a data signal is provided to charge the storage unit through the charging unit.

Preferably, the light-emitting control signal is set to maintain at a low level for a period of time and then change to a high level after the scanning signal changes from the high level to the low level.

Preferably, in the charging phase of the pixel driving circuit, the first transistor and the third transistor are turned off, the second transistor is turned on, and the driving transistor is also turned on at the same time, and the data signal is used to charge the storage capacitor by controlling a gate voltage of the driving transistor, until the driving transistor is turned off.

Preferably, in the driving phase of the pixel driving circuit, the first transistor and the third transistor are turned on, the switch transistor of the reset unit and the second transistor are turned off, and the driving transistor is turned on to drive the light-emitting element.

Preferably, the light-emitting control signal can be set to maintain at a low level for a period of time, i.e., entering a buffering phase, and then change to a high level, after the charging phase of the pixel driving circuit.

Preferably, when the scanning signal and the light-emitting control signal are at a low level, the first transistor, the second transistor and the third transistor are turned off, the switch transistor of the reset unit is turned off, and the driving transistor maintains in a turn-off state.

BRIEF DESCRIPTION OF THE DRAWINGS

The above and other purposes, features, and advantages of the present disclosure will be more clear by describing preferable embodiments of the present disclosure with reference to accompanying drawings, in which.

DETAILED DESCRIPTION

The exemplary embodiments of the present disclosure will be described in detail below in conjunction with accompanying drawings. In the following description, some specific embodiments are only examples of the present disclosure, which are merely used for the purpose of description, and should not be construed as limiting the present disclosure. General structures or constructions will be omitted so as not to obscure the understanding of the present disclosure.

Figure 1:
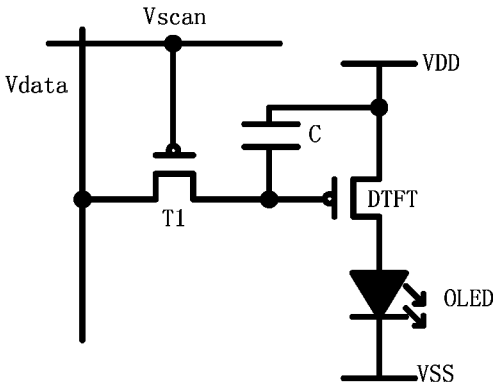
Prior Art Fig. 1
FIG. 1 is a structural diagram of a conventional pixel driving circuit.
Figure 2:
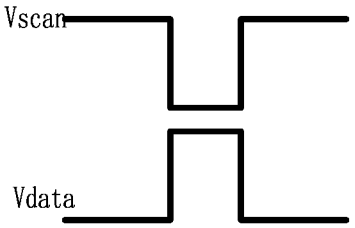
Prior Art Fig. 2
FIG. 2 is a timing diagram of an operation of a conventional pixel driving circuit.
Figure 3:
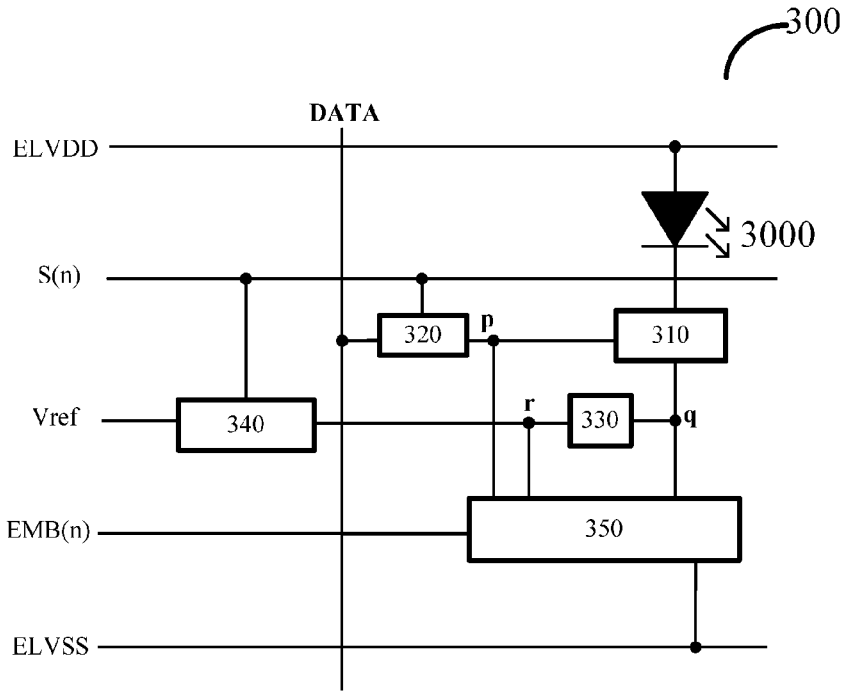
FIG. 3 is a structural diagram of a pixel driving circuit in a display apparatus according to an embodiment of the present disclosure.

FIG. 3 is a structural diagram of a pixel driving circuit 300 in a display apparatus according to an embodiment of the present disclosure. The pixel driving circuit 300 is used to drive a light-emitting element 3000. In FIG. 3, the light-emitting element 3000 is illustrated as a light-emitting diode OLED. As shown in FIG. 3, the pixel driving circuit 300 according to the embodiment of the present disclosure comprises a scanning line S(n) configured to provide a scanning signal; a power line comprising a first power line ELVDD and a second power line ELVSS and configured to provide power to the pixel driving circuit 300; a data line DATA configured to provide a data signal; and a light-emitting control signal line EMB(n) configured to provide a light-emitting control signal. The pixel driving circuit 300 further comprises: a driving unit 310 having an input end connected to one end of the light-emitting element, a control end connected to a first intermediate node p, and an output end connected to a second intermediate node q, wherein the light-emitting element has the other end connected to the first power line ELVDD; a charging unit 320 having an input end connected to the data line DATA, a control end connected to the scanning line S(n), and an output end connected to the first intermediate node p; a storage unit 330 having a first end connected to the second intermediate node q and a second end connected to a third intermediate node r; a reset unit 340 having an input end connected to a reference signal line Vref, a control end connected to the scanning line s(n), and an output end connected to the third intermediate node r; and a light-emitting control unit 350 having a first input end connected to the second power line ELVSS, a second input end connected to the first intermediate node p, a control end connected to the light-emitting control signal line EMB(n), a first output end connected to the second intermediate node q, and a second output end connected to the third intermediate node r.

In a charging phase of the pixel driving circuit 300, the data line and the first intermediate node p are conducted by the charging unit 320 and the reference signal line Vref and the third intermediate node r are conducted by the reset unit 340 under the control of the scanning signal, the driving unit 310 provides a charging voltage related to a data voltage and a threshold voltage thereof at the output end under the control of the data signal, and the storage unit 330 storages the charging voltage via the second intermediate node q.

In a driving phase of the pixel driving circuit, the first intermediate node p and the third intermediate node r are conducted by the light-emitting control unit 350 under the control of the light-emitting control signal provided by the light-emitting control signal line EMB(n), to conduct the second end of the storage unit 330 and the control end of the driving unit 310, so that driving current provided by the driving unit 310 to the light-emitting element 3000 is unrelated to the threshold voltage thereof.

Figure 4:
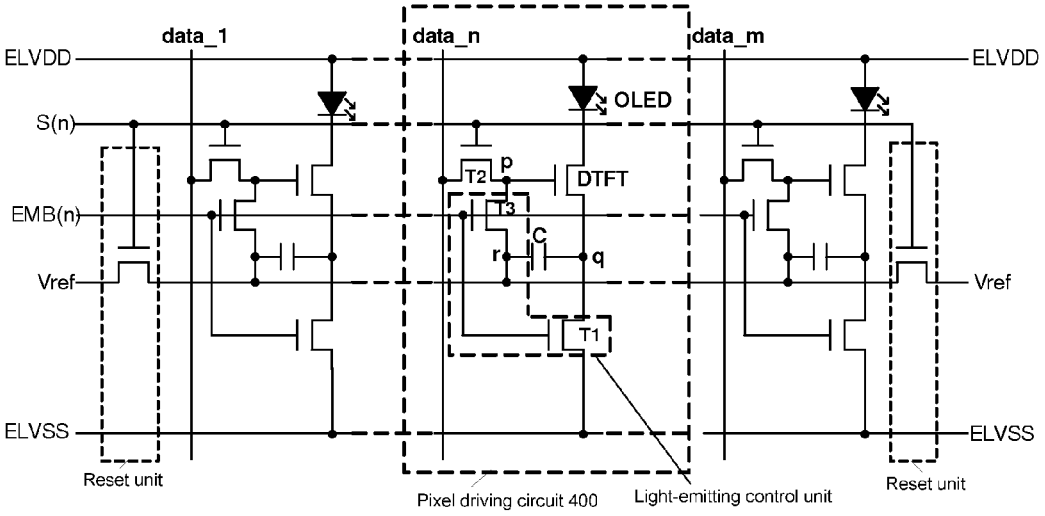
FIG. 4 is a structural diagram of a pixel driving circuit in a display apparatus according to another embodiment of the present disclosure.

FIG. 4 is a structural diagram of a pixel driving circuit in a display apparatus according to another embodiment of the present disclosure.

As shown in FIG. 4, the pixel driving circuit 400 according to the embodiment of the present disclosure comprises: a scanning line S(n) configured to provide a scanning signal; a power line comprising a first power line ELVDD and a second power line ELVSS and configured to provide power to the pixel driving circuit 400; a data line data_n configured to provide a data signal; and a light-emitting control signal line EMB(n) configured to provide a light-emitting control signal.

As shown in FIG. 4, in the pixel driving circuit 400 according to the embodiment of the present disclosure, the driving unit comprises a driving transistor DTFT, having a gate connected to the first intermediate node p, a drain connected to one end of the light-emitting element, and a source connected to the second intermediate node q. In the embodiment, the driving transistor has the drain corresponding to the input end of the driving unit, the gate corresponding to the control end of the driving unit, and the source corresponding to the output end of the driving unit.

As shown in FIG. 4, in the pixel driving circuit 400 according to the embodiment of the present disclosure, the reset unit comprises: a switch transistor having a gate connected to the scanning line S(n), a source connected to the reference signal line, and a drain connected to the third intermediate node r. In the embodiment, the switch transistor has the source corresponding to the input end of the reset unit, the gate corresponding to the control end of the reset unit, and the drain corresponding to the output end of the reset unit.

As shown in FIG. 4, in the pixel driving circuit 400 according to the embodiment of the present disclosure, the light-emitting control unit comprises a first transistor T1 and a third transistor T3, in which each of the first transistor T1 and the third transistor T3 has a gate connected to the light-emitting control signal line EMB(n), the first transistor has a drain connected to the second intermediate node q and a source connected to the second power line ELVSS, and the third transistor has a drain connected to the first intermediate node p and a source connected to the third intermediate node r. In the embodiment, the first transistor has the source corresponding to the first input end of the light-emitting control unit, the third transistor has the drain corresponding to the second input end of the light-emitting control unit, each of first transistor and the third transistor has the gate corresponding to the control end of the light-emitting control unit, the first transistor has the drain corresponding to the first out end of the light-emitting control unit, and the third transistor has the source corresponding to the second out end of the light-emitting control unit.

As shown in FIG. 4, in the pixel driving circuit 400 according to the embodiment of the present disclosure, the charging unit comprises a second transistor T2 having a gate connected to the scanning line S(n), a drain connected to the data line data_n, and a source connected to the first intermediate node p. In the embodiment, the second transistor has the drain corresponding to the input end of the charging unit, the gate corresponding to the control end of the charging unit, and the source corresponding to the output end of the charging unit.

As shown in FIG. 4, in the pixel driving circuit 400 according to the embodiment of the present disclosure, the storage unit comprises a storage capacitor C. The storage capacitor C is connected between the second intermediate node p and the third intermediate node r.

The driving thin film transistor DTFT, the switch transistor, the first transistor T1, the second transistor T2, and the third transistor T3 illustrated in FIG. 4 may be N-type thin film transistors. According to the type of the transistors which are used, the source and the drain of each of the driving thin film transistor DTFT, the switch transistor, the first transistor T1, the second transistor T2, and the third transistor T3 may be interchanged.

The N-type transistors may be enhancement transistors made in the LTPS process, or may also be depletion transistors made in the Oxide process. Of course, various transistors according to the embodiment of the present disclosure may also be other types of transistors.

Figure 5:
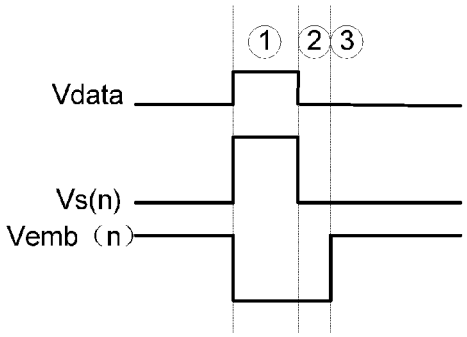
FIG. 5 is a timing diagram of an operation of a pixel driving circuit in a display apparatus according to another embodiment of the present disclosure.

FIG. 5 is a timing diagram of an operation of a pixel driving circuit 400 according to an embodiment of the present disclosure. As shown in FIG. 5, the pixel driving circuit 400 has three phases, i.e., a first phase, which is a charging phase, a second phase, which is a buffering phase, and a third phase, which is a driving phase.

Figure 6:
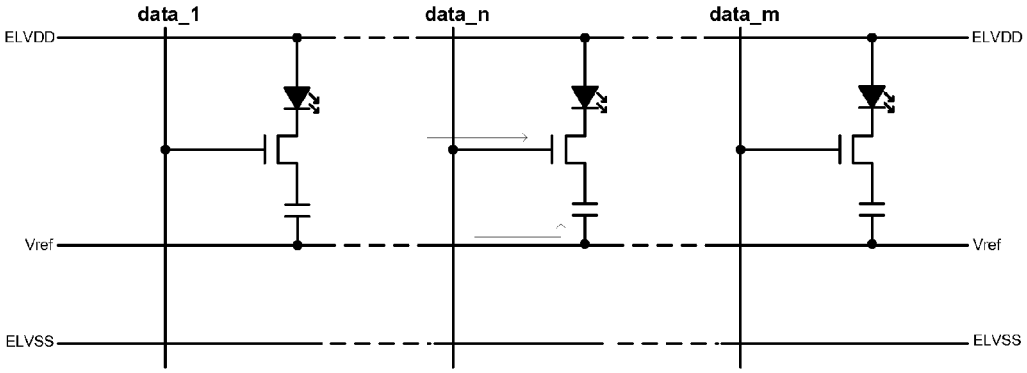
FIG. 6 is an equivalent circuit diagram of a pixel driving circuit in a display apparatus according to another embodiment of the present disclosure in a charging phase.
Figure 7:
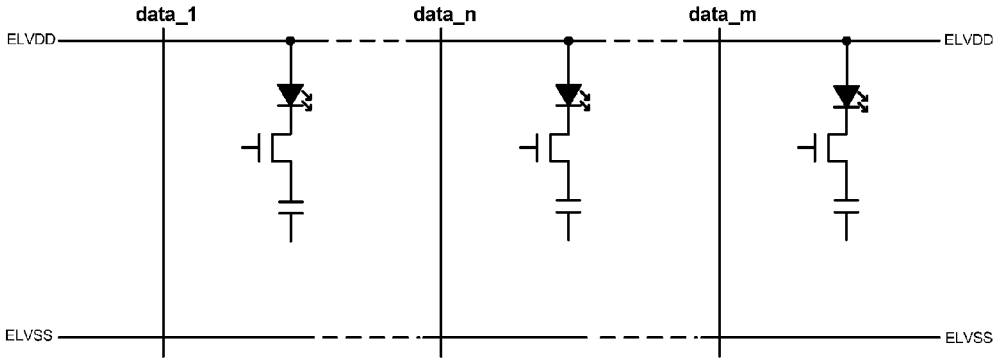
FIG. 7 is an equivalent circuit diagram of a pixel driving circuit in a display apparatus according to another embodiment of the present disclosure in a buffering phase.
Figure 8:
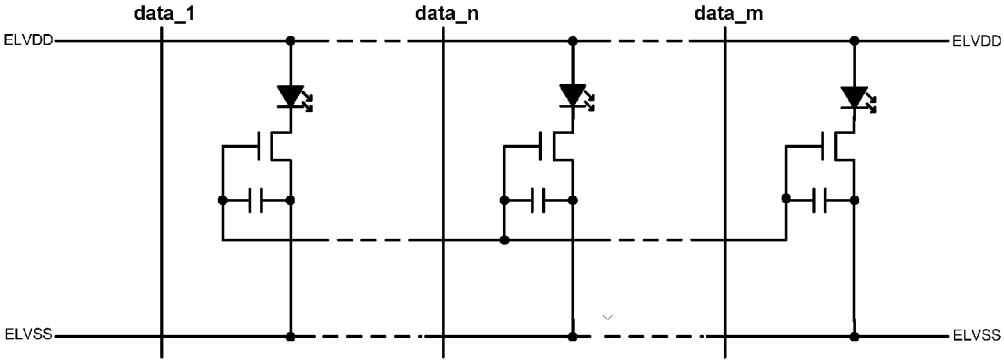
FIG. 8 is an equivalent circuit diagram of a pixel driving circuit in a display apparatus according to another embodiment of the present disclosure in a driving phase.

FIG. 6 is an equivalent circuit diagram of a pixel driving circuit 400 according to an embodiment of the present disclosure in a charging phase. FIG. 7 is an equivalent circuit diagram of a pixel driving circuit 400 according to an embodiment of the present disclosure in a buffering phase. FIG. 8 is an equivalent circuit diagram of a pixel driving circuit 400 according to an embodiment of the present disclosure in a driving phase. The operation flow of the pixel driving circuit 400 according to the embodiment of the present disclosure will described below in conjunction with FIGS. 5-8.

In a first phase, the scanning signal Vs(n) provided by the scanning line S(n) is a at a high level, the data line provides a data signal Vdata, and the light-emitting control signal Vemb(n) provided by the light-emitting control signal line EMB(n) is at a low level. The reference signal line provides a direct current reference voltage larger than the data voltage. For an $n^{th}$ pixel, T1 and T3 are turned off, T2 is turned on, and the switch transistor of the reset unit is also turned on under the control of the scanning signal. Therefore, the reference level provided by the reference signal line Vref achieves point r of the $n^{th}$ pixel, and at the same time the voltage of the data signal Vdata achieves the gate of the DTFT. As the source of the DTFT is connected to the low level ELVSS of the power source before T1 is turned off, after T1 is turned off, the DTFT has not charged the storage capacitor C, and a potential at point q is still ELVSS. As the voltage of the data signal Vdata is higher than ELVSS, the DTFT is turned on, a higher level of the drain of the DTFT is used to charge the storage capacitor C through the DTFT, and the potential at the point q continuously increases, until the potential at point q achieves Vdata−Vthd. At this time, the DTFT is turned off. Vthd is the threshold voltage of the DTFT, and is positive for a TFT made in the LTPS process, and may be negative for a TFT made in the Oxide process. At this time, a voltage between both ends of the storage capacitor C is Vc=Vref−(Vdata−Vthd).

In a second phase, the scanning signal Vs(n) provided by the scanning line S(n) changes to a low level, the data signal Vdata provided by the data line changes to a low level, and the light-emitting control signal Vemb(n) maintains at a low level. For an $n^{th}$ pixel, T1, T2 and T3 are turned off, the switch transistor of the reset unit is turned off, and the DTFT maintains in a turn-off state. This phase is a buffering phase, and is primarily used to avoid a hash signal due to simultaneous jump of signals.

In a third phase, the scanning signal Vs(n) provided by the scanning line S(n) maintains at a low level, the data signal Vdata provided by the data line maintains at a low level, and the light-emitting control signal Vemb(n) changes to a high level. For an $n^{th}$ pixel, T1 and T3 are turned on, and the switch transistor of the reset unit and T2 are turned off. As T2 is turned off, the voltage Vc between both ends of the storage capacitor C maintains unchanged. At this time, Vc is a gate-source voltage of the DTFT, i.e., Vgs=Vc=Vref−(Vdata−Vthd), and light-emitting current flowing through the light-emitting element OLED is decided by the voltage Vgs of the DTFT.

$$\begin{aligned} I_{oled} &= K(Vgs - Vthd)\hat{}2 \\ &= K(Vc - Vthd)\hat{}2 \\ &= K[Vref - (Vdata - Vthd) - Vthd]\hat{}2 \\ &= K(Vref - Vdata)\hat{}2. \end{aligned}$$

It can be known from the above equation that current for driving the OLED to emit light is merely related to the reference voltage Vref and the data voltage Vdata, and is unrelated to the threshold voltage Vthd of the DTFT, wherein K is a constant related to a process and a design. As Vref is larger than or equal to Vdata, $I_{oded}$ has a minimum value of 0, which represents being at 0 gray scale.

Although the buffering phase is provided in the embodiments described above, it can be understood by those skilled in the art that the buffering phase is used to avoid a hash signal due to simultaneous jump of signals. Obviously, the buffering phase is not necessary.

Figure 9:
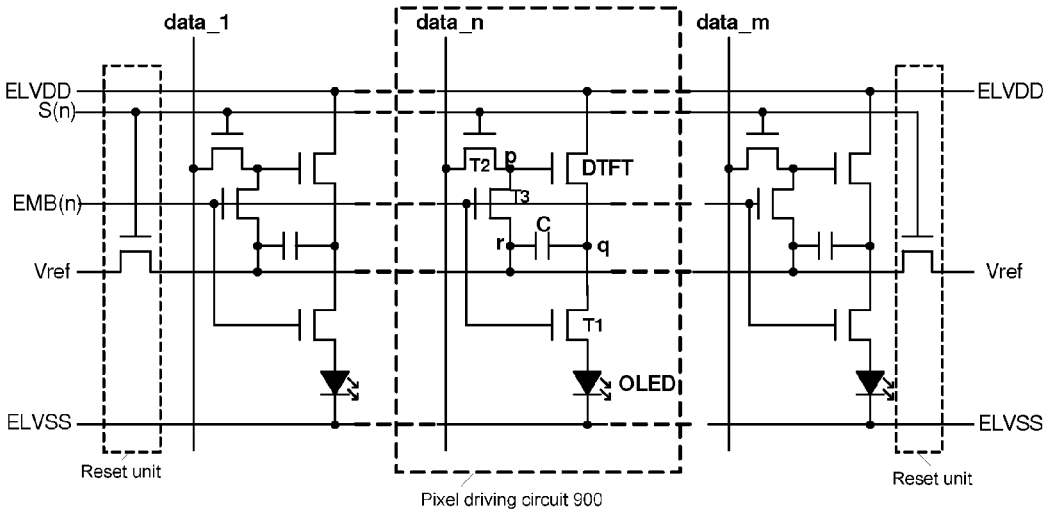
FIG. 9 is an structural diagram of a pixel driving circuit in a display apparatus according to another embodiment of the present disclosure.

FIG. 9 illustrates a structural diagram of a pixel driving circuit 900 in a display apparatus according to another embodiment of the present disclosure.

The pixel driving circuit 900 according to the embodiment differs from the pixel driving circuit 400 illustrated in FIG. 4 only in that the light-emitting element OLED moves from the drain of the driving transistor DTFT to the source of the driving transistor DTFT. Other elements maintain unchanged. The timing of the operation of the circuit is the same as that in the implementation of the pixel driving circuit illustrated in FIG. 4, which will not be described here for brevity.

Although the specific structures of the driving unit, the charging unit, the storage unit, the reset unit, and the light-emitting control unit are illustrated in FIGS. 4 and 9, it can be understood by those skilled in the art that these units may use other structures. FIGS. 4 and 9 merely illustrate an example thereof.

It can be seen from FIG. 4 that the display apparatus comprises multiple light-emitting elements and pixel driving circuits for driving respective light-emitting elements. Various pixel driving circuits have the same reset unit, and the reset unit is controlled by a scanning signal. Therefore, according to the embodiment of the present disclosure, a row of pixel driving circuits connected to the same scanning line may share one reset unit. The shared reset unit is outside each pixel driving circuit as illustrated in FIG. 4, and is shared by multiple light-emitting elements (i.e., being shared by pixel driving units). The shared reset unit may be arranged outside an active display area of the display apparatus, so that an aperture rate of the pixels is largely increased. Thereby, a current density of the organic light-emitting layer is reduced while acquiring uniform display brightness, thereby extending the usage life of the display panel.

Similarly, in the display apparatus illustrated in FIG. 9, a row of pixel driving units share one reset unit. In FIGS. 4 and 9, two shared reset units are illustrated at the beginning and the end of one row to reduce delay of current received by pixels at the end due to a long distance between the pixels at the end and the reset unit at the beginning. A row of light-emitting elements may share one reset unit.

Figure 10:
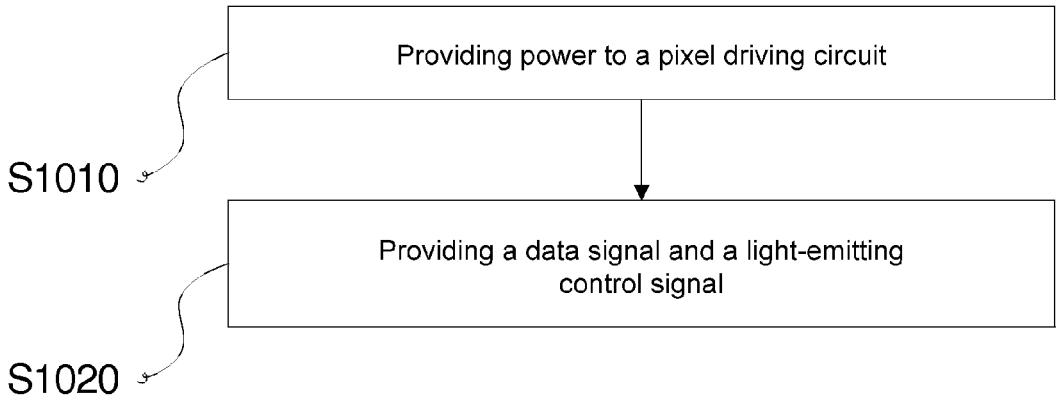
FIG. 10 is a flowchart of a pixel driving method according to an embodiment of the present disclosure.

FIG. 10 illustrates a flowchart of a pixel driving method according to an embodiment of the present disclosure. The method is applied in the pixel driving circuit according to the embodiment of the present disclosure. As shown, the driving method comprises the following steps. Firstly, in S1010, power is provided to the pixel driving circuit through a power line. Then, in S1020, a scanning signal is provided through the scanning line, and a light-emitting control signal is provided through the light-emitting signal line, wherein the light-emitting control signal is at a low level when the scanning signal is at a high level, so that the pixel driving circuit enters a charging phase, and the light-emitting control signal changes to a high level when the scanning signal changes to a low level, so that the pixel driving circuit enters a driving phase.

As shown in FIG. 5, when a row of pixels are selected by the scanning signal, i.e., when the scanning signal is at a high level, a data signal is provided for an $n^{th}$ pixel. In this case, the light-emitting control signal Vemb(n) is at a low level, and the data signal is used to charge the storage capacitor C. When the scanning signal changes to a low level, the light-emitting control signal changes to a high level, the pixel driving circuit enters a driving phase, and the driving unit provides driving current to the light-emitting element. As the storage capacitor compensates for the threshold voltage of the driving unit, the driving current provided by the driving unit to the light-emitting element is unrelated to the threshold voltage of the driving unit.

As described above, in order to enable the pixel driving circuit to be more stable, a buffering phase may be provided between the charging phase and the driving phase. Therefore, the light-emitting control signal Vemb(n) may be set to maintain at a low level for a period of time and then change to a high level after the scanning signal changes from the high level to the low level. That is, the pixel driving circuit enters a driving phase.

More specifically, in combination with the pixel driving circuit illustrated in FIG. 4, when the operation timing illustrated in FIG. 5 is applied, in the charging phase of the pixel driving circuit, the first transistor and the third transistor are turned off, the second transistor is turned on, the driving transistor is also turned on at the same time, and the data signal is used to charge the storage capacitor by controlling the gate voltage of the driving transistor, until the driving transistor is turned off. When the scanning signal and the light-emitting control signal are at a low level, the first transistor, the second transistor and the third transistor are turned off, the switch transistor of the reset unit is turned off, and the driving transistor maintains in a turn-off state. In the driving phase of the pixel driving circuit, the first transistor and the third transistor are turned on, the switch transistor of the reset unit and the second transistor are turned off, and the driving transistor is turned on to drive the light-emitting element.

Compared with conventional technology, in the pixel driving circuit according to the embodiments of the present disclosure, a reset unit is arranged to enable the storage capacitor to store not only a data voltage but also a threshold voltage of the driving unit in the charging phase, to compensate for the driving unit in the driving phase, so that the operating current of the driving unit is not influenced by the threshold voltage. This eliminates the influence of the threshold voltage of the driving unit to the operating current of the driving unit, thereby solving the technical problem of non-uniformity of display brightness of the light-emitting elements due to inconsistency of threshold voltages of the driving unit. Further, a circuit (i.e., a reset unit) shared by pixel driving circuits of each row of light-emitting elements is moved outside an active display area, which can significantly increase the aperture rate of the pixels. In this way, the current density of the organic light-emitting layer is reduced while acquiring uniform display brightness, thereby extending the usage life of the display panel.

It should be noted that the technical solutions of the present disclosure are merely described by way of example in the above description, and it does not mean that the present disclosure is limited to the above steps and structures. The steps and structures may be adjusted and selected as needed if possible. Therefore, some steps and units are not elements necessary for implementing the general inventive idea of the present disclosure. Consequently, the technical features necessary for the present disclosure are merely limited by the minimum requirements for implementing the general inventive idea of the present disclosure instead of the above specific examples.

The present disclosure has been described herein in conjunction with preferable embodiments. It should be understood that various other changes, substitutions and additions can be made by those skilled in the art without departing from the spirit and scope of the present disclosure. Therefore, the scope of the present disclosure is not limited to the above particular embodiments, and should be defined by the appended claims.

We claim:

1. A pixel driving circuit for driving a light-emitting element, comprising:

a scanning line configured to provide a scanning signal; a power line comprising a first power line and a second power line and configured to provide power to the pixel driving circuit; and a data line configured to provide a data signal;

a light-emitting control signal line configured to provide a light-emitting control signal;

a driving transistor having an input terminal connected to a first terminal of the light-emitting element, a control terminal connected to a first intermediate node, and an output terminal connected to a second intermediate node, wherein the light-emitting element has the other terminal connected to the first power line;

a charging sub-circuit having an input terminal connected to the data line, a control terminal connected to the scanning line, and an output terminal connected to the first intermediate node;

a storage capacitor having a first terminal connected to the second intermediate node and a second terminal connected to a third intermediate node;

a reset sub-circuit having an input terminal connected to a reference signal line, a control terminal connected to the scanning line, and an output terminal connected to the third intermediate node; and a light-emitting control sub-circuit having a first input terminal connected to the second power line, a second input terminal connected to the first intermediate node, a control terminal connected to the light-emitting control signal line, a first output terminal connected to the second intermediate node, and a second output terminal connected to the third intermediate node;

wherein the data line and the first intermediate node are connected electronically by the charging sub-circuit and the reference signal line and the third intermediate node are connected electronically by the reset sub-circuit under a control of the scanning signal, the driving transistor provides a charging voltage related to a data voltage and a threshold voltage thereof at the output terminal under a control of the data signal, and the storage capacitor storages the charging voltage; and the first intermediate node and the third intermediate node are connected electronically by the light-emitting control sub-circuit under a control of the light-emitting control signal, so that the second terminal of the storage capacitor and the control terminal of the driving transistor are connected electronically;

wherein the reference signal line provides a direct current reference voltage larger than the data voltage, and the reset sub-circuit comprises:

a switch transistor having a gate connected to the scanning line, a first electrode connected to the reference signal line, and a second electrode connected to the third intermediate node, wherein the first electrode is one of a source and a drain, and the second electrode is the other of the source and the drain.

2. The pixel driving circuit according to claim 1, wherein the driving transistor has a gate connected to the first intermediate node, a first electrode connected to said first terminal of the light-emitting element, and a second electrode connected to the second intermediate node, wherein the first electrode is one of a source and a drain, and the second electrode is the other of the source and the drain.

3. The pixel driving circuit according to claim 1, wherein the light-emitting control sub-circuit comprises a first transistor and a third transistor, in which each of the first transistor and the third transistor has a gate connected to the light-emitting control signal line, the first transistor has a first electrode connected to the second intermediate node and a second electrode connected to the second power line, and the third transistor has a first electrode connected to the first intermediate node and a second electrode connected to the third intermediate node, wherein the first electrode is one of a source and a drain, and the second electrode is the other of the source and the drain.

4. The pixel driving circuit according to claim 3, wherein the charging sub-circuit comprises a second transistor having a gate connected to the scanning line, a first electrode connected to the data line, and a second electrode connected to the first intermediate node, wherein the first electrode is one of a source and a drain, and the second electrode is the other of the source and the drain.

5. The pixel driving circuit according to claim 4, wherein the driving transistor, the switch transistor, the first transistor, the second transistor and the third transistor are N-type thin film transistors.

6. A pixel driving method applied in the pixel driving circuit according to claim 4, comprising:

providing power to the pixel driving circuit through a power line;

providing a scanning signal through the scanning line; and providing a light-emitting control signal through the light-emitting signal line, wherein the light-emitting control signal is at a low level when the scanning signal is at a high level, so that the pixel driving circuit enters a charging phase, and the light-emitting control signal changes to a high level when the scanning signal changes from the high level to a low level, so that the pixel driving circuit enters a driving phase;

wherein when the scanning signal is at a high level, a data signal is provided to charge the storage capacitor through the charging sub-circuit; and wherein in the charging phase of the pixel driving circuit, the first transistor and the third transistor are turned off, the second transistor is turned on, and the driving transistor is also turned on at the same time, and the data signal is used to charge the storage capacitor by controlling a gate voltage of the driving transistor, until the driving transistor is turned off.

7. A pixel driving method applied in the pixel driving circuit according to claim 4, comprising:

providing power to the pixel driving circuit through a power line;

providing a scanning signal through the scanning line; and providing a light-emitting control signal through the light-emitting signal line, wherein the light-emitting control signal is at a low level when the scanning signal is at a high level, so that the pixel driving circuit enters a charging phase, and the light-emitting control signal changes to a high level when the scanning signal changes from the high level to a low level, so that the pixel driving circuit enters a driving phase;

wherein when the scanning signal is at a high level, a data signal is provided to charge the storage capacitor through the charging sub-circuit; and wherein in the driving phase of the pixel driving circuit, the first transistor and the third transistor are turned on, the switch transistor of the reset sub-circuit and the second transistor are turned off, and the driving transistor is turned on to drive the light-emitting element.

8. A pixel driving method applied in the pixel driving circuit according to claim 4, comprising:

providing power to the pixel driving circuit through a power line;

providing a scanning signal through the scanning line; and providing a light-emitting control signal through the light-emitting signal line, wherein the light-emitting control signal is at a low level when the scanning signal is at a high level, so that the pixel driving circuit enters a charging phase, and the light-emitting control signal changes to a high level when the scanning signal changes from the high level to a low level, so that the pixel driving circuit enters a driving phase;

wherein when the scanning signal is at a high level, a data signal is provided to charge the storage capacitor through the charging sub-circuit;

wherein the light-emitting control signal is set to maintain at a low level for a period of time and then change to a high level after the scanning signal changes from the high level to the low level; and wherein when the scanning signal and the light-emitting control signal are at a low level, the first transistor, the second transistor and the third transistor are turned off, the switch transistor of the reset sub-circuit is turned off, and the driving transistor maintains in a turn-off state.

9. A display apparatus, comprising multiple light-emitting elements and the pixel driving circuits for driving the light-emitting elements according to claim 1.

10. The display apparatus according to claim 9, wherein a row of pixel driving circuits connected to the same scanning line share a reset sub-circuit.

11. The display apparatus according to claim 9, wherein the shared reset sub-circuit is arranged outside an active display area.

12. A pixel driving method applied in the pixel driving circuit according to claim 1, comprising:

providing power to the pixel driving circuit through a power line;

providing a scanning signal through the scanning line; and providing a light-emitting control signal through the light-emitting signal line, wherein the light-emitting control signal is at a low level when the scanning signal is at a high level, so that the pixel driving circuit enters a charging phase, and the light-emitting control signal changes to a high level when the scanning signal changes from the high level to a low level, so that the pixel driving circuit enters a driving phase.

13. The pixel driving method according to claim 12, wherein when the scanning signal is at a high level, a data signal is provided to charge the storage capacitor through the charging sub-circuit.

14. The pixel driving method according to claim 13, wherein the light-emitting control signal is set to maintain at a low level for a period of time and then change to a high level after the scanning signal changes from the high level to the low level.

* * * * *